United States Patent [19]

King

[11] 4,318,343

[45] Mar. 9, 1982

[54] DUAL MODE INCENDIARY BOMBLET

[75] Inventor: James B. King, Ashland, Oreg.

[73] Assignee: The United States of America as represented by the Secretary of the Navy, Washington, D.C.

[21] Appl. No.: 173,281

[22] Filed: Aug. 19, 1971

[51] Int. Cl.[3] ..... F42B 25/14

[52] U.S. Cl. ..... 102/365; 102/394

[58] Field of Search ..... 102/6, 65, 66, 90, 7.2

[56] References Cited

U.S. PATENT DOCUMENTS

| | | | |
|---|---|---|---|
| 1,237,012 | 8/1917 | Barlow | 102/7.2 |
| 1,791,716 | 2/1931 | Davis et al. | 102/6 |
| 2,586,801 | 2/1952 | Epler et al. | 102/6 |
| 2,737,114 | 3/1956 | Hershberg | 102/6 |
| 2,741,177 | 4/1956 | Richards, Jr. et al. | 102/6 |
| 2,959,127 | 11/1960 | Weinert | 102/65 |
| 3,296,967 | 1/1967 | Bounds et al. | 102/90 X |
| 3,467,012 | 9/1969 | Ladof | 102/66 X |

*Primary Examiner*—David H. Brown

*Attorney, Agent, or Firm*—Robert F. Beers; W. Thom Skeer; Lloyd E. K. Pohl

[57] ABSTRACT

A dual mode incendiary bomblet which combines the effects of a jetting incendiary and a slow burning incendiary. A gas producing ejection means within the housing of the bomblet ejects the incendiary package (burning portion) of the bomblet and assures that it will burn adjacent to a target.

3 Claims, 4 Drawing Figures

DUAL MODE INCENDIARY BOMBLET

BACKGROUND OF THE INVENTION

1. Field of the Invention

This invention relates to incendiary bomblets. More particularly, this invention relates to incendiary bomblets of the type used to penetrate roofs of structures and ignite fires within the structures.

2. Description of the Prior Art

Incendiary bomblets are known. In the military arts it is often desirable to ignite fires and incendiary bomblets are used for this purpose.

Targets suitable for incendiary attack are composed of or contain a portion of wood, cellulosic material or flammable liquids. Targets composed of or containing such materials are often stored within buildings or other structures. The purpose of an incendiary bomblet is to penetrate into a structure and ignite one or more fires in the flammables contained within the structure or to ignite the structure itself.

There are, in general, two types of prior art incendiary bomblets. One type burns quickly with an extremely hot jetting flame. The other type burns slowly with a relatively low temperature flame. That is, the flame of a slow burning bomblet does not produce temperatures as hot as those produced by the flame of a jetting type. Each type has certain disadvantages associated with it.

A typical prior art jetting incendiary somewhat resembles a rocket in the manner which it burns. That is, flame jets out of one end of a bomblet housing which contains the flame producing material. The primary disadvantage associated with this type of bomblet is that the burning materials used to produce the flame produce hot gases which cause the housing and its contents to slide and spin about and prevent the flame from being directed at any one area for any appreciable length of time. Thus, even though the flame is extremely hot, it is often not directed at any particular target long enough to raise the temperature of the target to its kindling point. Furthermore, even the longest burning jetting incendiaries only burn for approximately 20 to 30 seconds.

Slow burning incendiaries do not spin around spraying flame willy-nilly as do jetting incendiaries. Nor are they so short lived. The main disadvantage associated with slow burning incendiaries is that they oftentimes do not land close to a target. If a slow burning incendiary bomblet crashes through the roof of a building and lands in an open space within the building, the flames will never touch a flammable target and the bomblet will merely burn itself out ineffectually. If a slow burning incendiary lands adjacent to a fire retardent object, for example, one fabricated from a material such as steel, it will also burn itself out ineffectually because the flame will not reach a temperature high enough to seriously damage the object.

The problem of attempting to ignite flammable materials in an office building is one example of the difficulties arising from the use of prior art incendiary bomblets. Office buildings contain papers and books which are flammable. However, the papers and books in an office building are usually contained within metallic desks or bookcases which are not flammable. Thus, the papers and books cannot be ignited by ordinary slow burning incendiary bomblets. That is, if an incendiary bomblet which utilizes a slow burning fuel, i.e., a fuel such as napalm, penetrates into an office building and lands adjacent to a metallic desk, the only damage that will be done will be that of scorching the desk. Papers and books within the desk will not be affected because the flame of the incendiary will not produce a temperature high enough to destroy the desk. Furthermore, if such a bomblet lands in an open space within the building its flame will be completely ineffectual. If, on the other hand, a jetting incendiary penetrates into an office building and begins spinning and spraying flame in all directions, the chances that the flame will be directed at the desk for a period long enough to burn through the desk wall are very small even though the flame could easily do so if it had enough time.

SUMMARY OF THE INVENTION

A dual mode incendiary bomblet which combines the effects of a slow burning incendiary and which also insures that the flame of the bomblet will be adjacent to a target where it can do damage is made available by this invention. A dual mode incendiary bomblet according to this invention utilizes jetting incendiaries to produce very hot flames which will burn through ordinarily nonflammable materials such as metallic desk walls and also utilizes a slow burning fuel to maintain heat flux and insure that any flammable materials protected by the wall will be ignited. The flames of a bomblet according to this invention are assured of being close to a target by a gas producing ejection means which ejects the incendiary package from the housing of the bomblet and causes it to slide across the floor until it is stopped by a target. Flames from the jetting portions of the incendiary package jet out in several opposing directions. Thus, the force vector on a working incendiary package is substantially zero and the package does not tend to roll or spin.

DESCRIPTION OF THE PREFERRED EMBODIMENTS

Figure 1:
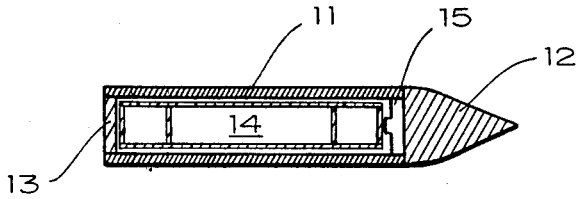
FIG. 1 is a cross sectional view of an incendiary bomblet according to this invention.

Going first to the drawing in which like or similar parts are indicated by like numerals, a dual mode incendiary bomblet is depicted in cross section in FIG. 1. The bomblet comprises a housing with a dual mode incendiary package 14 within it. The housing is made up of a hollow outer cylindrical tube 11, a penetration point 12 affixed to one end of the tube and forming one end wall thereof, and a plug 13 affixed at the other end of the tube and forming the other end wall thereof. In addition to the incendiary package, an ejection cartridge 15 is disposed within the housing adjacent to and supported by the wall formed by the penetration point.

The outer cylindrical tube 11, the metallic penetration point 12, and the plug 13 are fabricated from any suitable metal or alloy such as aluminum or steel. Their composition is not critical with the exception that it is preferable that they be massive enough so that their mass in conjunction with the acceleration of gravity will produce enough force to enable them to pass through the roof of a building when they are dropped upon it from an aircraft. That is, one function of the housing is to insure that the dual mode incendiary package contained within it reaches the interior of a building if the bomblet strikes a roof as it is falling from an aircraft. Actually, steel is the preferred material for the three parts (housing, point and plug). However, aluminum, even though it is lighter than steel, performs adequately and there are many other metallic materials which could be used. Also, certain plastic materials could be used.

Figure 2:
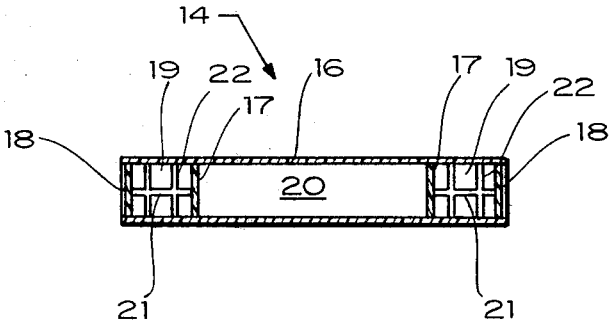
FIG. 2 is a cross sectional view of an incendiary package of a bomblet according to this invention.

FIG. 2 is a cross sectional view of an incendiary package 14 according to this invention. The incendiary package comprises an inflammable cylindrical case 16 divided into three compartments by two inflammable partitions 17 and two inflammable end plugs 18. Contained within the two endmost compartments of the case are two jetting incendiaries 19. Contained within the central compartment sandwiched between the two jetting incendiaries is a slow burning fuel packet 20. The incendiary package has an outer diameter small enough to permit it to slide easily within the interior of the outer cylindrical tube.

The inflammable cylindrical case 16, the partitions 17 and the inflammable end plugs 18 are preferably fabricated from celluloid or the like. Certain cured polymeric compositions such as hydroxy terminated polybutadiene cured with toluene diisocyanate are also useful as materials from which to fabricate these parts.

The jetting incendiaries 19 are preferably fabricated from a mixture of plaster of paris (about 50 to about 60 weight percent) and powdered aluminum (about 50 to about 40 weight percent). To fabricate a jetting incendiary, the two materials are mixed together in the presence of enough water to make them easily manageable and then cast into a cylinder and dried. Drying is accomplished either by heating the cast cylinder in an oven at about 50° C. for about 2 days or by allowing the cylinder to air dry at ambient temperature for about one week. After the cylinder has been cast and dried, openings may be drilled into it.

Figure 3:
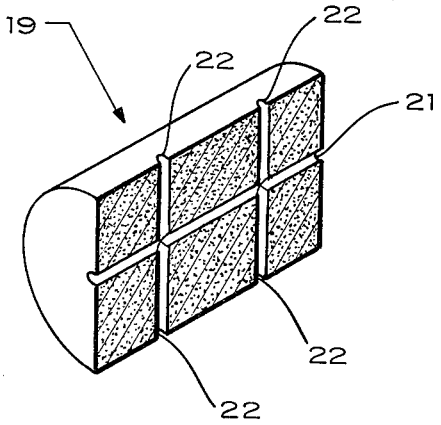
FIG. 3 is a perspective view, partly in cross section of a jetting incendiary according to this invention.

FIG. 3 is a perspective view, partly in cross section, of a jetting incendiary 19 which has openings drilled into it. The jetting incendiary contains an axial opening 21 and several lateral openings 22 which lead from the outer surface of the cylindrical jetting incendiary to the axial opening. These openings are preferably produced by a slow moving drill bit. The use of a high speed drill bit with its attendant heat could conceivably ignite the incendiary. It will be noted that two of the lateral openings are directly opposite the other two. Drilling the lateral openings in directly opposite pairs prevents the incendiary from rolling after it has been ignited. There could be less, i.e., two, or more, i.e., eight, sixteen, etc., lateral openings in lieu of the four shown in FIG. 3. Also, the lateral openings could be drilled in from four directions rather than two. In fact, it is preferable to have the lateral openings approach the axial opening from four directions rather than two because this insures that flames will jet out upwardly, downwardly and to both sides from a jetting incendiary which is lying in a horizontal position.

Figure 4:
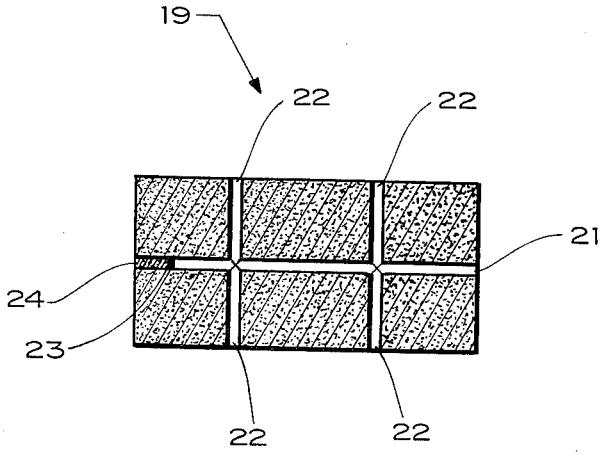
FIG. 4 is a cross sectional view of a jetting incendiary which has ignition means incorporated into it.

After a jetting incendiary has been cast and drilled as described above, ignition means is inserted into one end of the axial opening as shown in FIG. 4. One suitable ignition means consists of a magnesium-Teflon pellet 23 inserted about one inch into one end of the axial opening 21 and followed by an adjacent plug 24 fabricated from shellac coated black powder. Other materials such as thermite are suitable replacements for the magnesium-Teflon pellet 23. Any other easily ignitable material is suitable as a replacement for the plug.

The slow burning fuel packet contains a thickened hydrocarbon such as thickened hexane, heptane, octane, nonane or gasoline. For example a mixture of gasoline, benzene and polystyrene commonly known as napalm B is an excellent slow burning fuel. Another excellent slow burning fuel is gasoline thickened to a viscosity of from about 50,000 cps to about 70,000 cps with a mixture of rubber cement and hexane. Gasoline thickened with asphalt is still another excellent slow burning fuel. Any number of thickeners and hydrocarbons are compatible and suitable. The thickened hydrocarbon (slow burning fuel) is preferably contained in a flammable container such as a polyethylene sack before being placed in its compartment in the incendiary package.

Once an inflammable cylindrical case, its partitions and end plugs, two jetting incendiaries with ignition means inserted and one slow burning fuel packet have been fabricated, an incendiary package can be assembled as shown in FIG. 2. The jetting incendiaries are placed in their compartments of the inflammable cylindrical case so that the ends containing the ignition means are adjacent to the end plugs.

Once an incendiary package is assembled it is placed in a housing as depicted in FIG. 1. In addition to the incendiary package, the interior of the housing contains an ejection cartridge affixed to the interior wall formed by the penetration point. A suitable ejection cartridge is one which produces both a flame and gaseous products when it is detonated. For example, an ejection cartridge which utilizes a boron-potassium nitrate ejection charge is suitable. The ejection cartridge is detonated by means of a contact fuze and a delay train (not shown) which can be located anywhere on the bomblet as long as the delay fuse is not in contact with the inflammable cylindrical case of the incendiary package. For example, the contact fuse can be affixed to the nose of the penetration point and the delay train can run from the contact fuse to the ejection cartridge either through a channel in penetration point or through a channel in the wall of the cylindrical tube.

The plug 13 (see FIG. 1) which holds the duel mode incendiary package in place in the housing is affixed in a manner whereby it will be blown out of the end of the housing after the ejection cartridge has been detonated and gas pressure builds up within the housing. A wide choice of ways in which to affix the plug are available and any manner which assures that the plug will remain in place until it is removed by gas pressure is suitable. For example, the plug may be set in a groove around the inner periphery of the tube. On the other hand, a caplike plug may be placed over the end of the tube.

A dual mode incendiary bomblet of this invention is used in the following manner. Firstly, it is dropped from an aircraft so that it will hit the roof of a structure which contains the target. The penetration point and heavy nature of the housing enable it to penetrate through the roof and gain entrance to the target containing structure. Upon striking the roof the contact fuse is activated and it in turn activates the delay train. After passing through the roof, the bomblet will fall to the floor or some other horizontal surface in the building and roll to a standstill. During the time after the bomblet has struck the roof, when it is falling to the floor or other horizontal surface, the delay train is burning. In a few seconds, the delay train detonates the ejection cartridge. Flame from the ejection cartridge ignites the inflammable case of the incendiary package and, simultaneously, gas pressure builds up within the housing. When gas pressure has sufficiently built up, the plug holding the incendiary package in place is blown out of or off of the end of the tube. At the same time, the incendiary package is blown out of (ejected from) the housing. The force of the ejection causes the ignited incendiary package to slide across the surface of the floor until it comes into contact with some immovable object which stops it. This immovable object is the target. Thus, the incendiary package is assured of coming into contact with a target.

During the time immediately prior to or while the incendiary package is sliding across the floor, the burning case ignites the ignition means contained within the ends of the jetting incendiaries and the ignition means, in turn, ignite the jetting incendiaries. The jetting incendiaries burn from the inside out in a manner similar to that associated with solid rocket propellants. Extremely hot flames jet out through the lateral openings of the jetting incendiaries. Also, flames jet from the jetting incendiaries into the compartment which contains the slow burning fuel packet and ignite the packet. Flames jetting out from a jetting incendiary prepared as described above produce temperatures on the order of 3,200° F. and will extend for from about 4 to about 6 feet. One of these jetting flames will burn through a piece of metal similar to that from which metallic desks are made in approximately 3 seconds. Such a jetting flame will burn through a ¼ inch thick plywood board in about 4 seconds. They burn for approximately 20 to 30 seconds. A ½ pound polyethylene bag of thickened hydrocarbon burns for approximately 20 minutes. Thus, if a burning dual mode incendiary package comes to rest against, for example, an office desk, the following events occur. First, a jetting flame (or flames) burns a hole (or holes) in the wall of the desk. Then, the flame supplied by the slow burning fuel packet penetrates into the desk through the hole and ignites papers or other inflammable materials within the desk.

If a burning dual mode incendiary package comes to rest against a wooden wall, at least one of the flames from the jetting incendiary burns a hole through the wall and spreading flame from the slow burning fuel packet can then envelop both sides of the wall and eventually raise its temperature past the kindling point and ignite it.

The flames which jet from the axial openings of the jetting incendiaries into the slow burning fuel packet perform a function in addition to those of igniting the slow burning fuel and producing holes in noninflammable or difficulty inflammable materials. The added function is that of forcing the fuel to spread out over a wide, roughly oval area around the packet. In tests conducted with ½ pound polyethylene bags of gasoline and hexane thickened with rubber cement, the flames from the slow burning fuel spread over a cement floor area in an oval are having dimensions of approximately about 15 feet by about 20 feet. The flames reached heights of from about 18 inches to about 24 inches.

I claim:

1. A dual mode incendiary bomblet comprising:

(a) a hollow housing;

(b) a penetration point affixed to one end of the housing and closing that end of the housing;

(c) a removable plug closing the other end of the housing;

(d) a dual mode incendiary package contained within the housing, said dual mode incendiary package comprising a slow burning fuel packet sandwiched between two jetting incendiaries in an inflammable case, said jetting incendiaries being fabricated from a mixture of from about 50 to about 60 weight percent plaster of paris and about 50 to about 40 weight percent powdered aluminum respectively;

(e) ejection means contained within the housing adjacent to and supported by the end wall thereof which is formed by the penetration point; and (f) means for activating said ejection means.

2. A dual mode incendiary bomblet according to claim 1 wherein the fuel of said slow burning fuel packet is a hydrocarbon fuel selected from the group consisting of hexane, heptane, octane, nonane, and gasoline thickened to a viscosity of from about 50,000 cps to about 70,000 cps with a thickener selected from the group consisting of rubber cement and asphalt.

3. A dual mode incendiary bomblet according to claim 2 wherein said inflammable case is fabricated from a member of the group consisting of celluloid and hydroxy terminated polybutadiene cured with toluene diisocyanate.

* * * * *